US007610781B2

(12) United States Patent
Choi et al.

(10) Patent No.: US 7,610,781 B2
(45) Date of Patent: Nov. 3, 2009

(54) DRUM TYPE WASHING MACHINE

(75) Inventors: Dong Hyun Choi, Gunpo-si (KR); Woon Gu Hur, Suwon-si (KR); Won Seok Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 448 days.

(21) Appl. No.: 11/302,114

(22) Filed: Dec. 14, 2005

(65) Prior Publication Data

US 2007/0006618 A1 Jan. 11, 2007

(30) Foreign Application Priority Data

Jul. 7, 2005 (KR) ..... 10-2005-0061269

(51) Int. Cl.
*D06F 37/06* (2006.01)

(52) U.S. Cl. ..... 68/23.4; 68/142

(58) Field of Classification Search ..... 68/23.4, 68/58, 139, 142, 208
See application file for complete search history.

(56) References Cited

U.S. PATENT DOCUMENTS

| | | | | |
|---|---|---|---|---|
| 1,814,724 | A * | 7/1931 | McCormick | 68/142 |
| 1,822,215 | A * | 9/1931 | Harold | 68/139 |
| 2,561,186 | A * | 7/1951 | Dunham | 68/23.4 |
| 2,734,368 | A * | 2/1956 | Richardson | 68/142 |
| 2,764,884 | A * | 10/1956 | Constantine | 68/23.4 |
| 2,955,450 | A * | 10/1960 | Tingley, Jr. | 68/23.4 |
| 3,201,958 | A * | 8/1965 | Smith | 68/58 |
| 4,971,449 | A * | 11/1990 | Hendren | 366/228 |
| 5,307,652 | A * | 5/1994 | Hagiwara et al. | 68/27 |
| 5,392,480 | A * | 2/1995 | Ishihara et al. | 8/159 |
| 5,862,687 | A * | 1/1999 | Jang | 68/142 |
| 6,386,004 | B2 * | 5/2002 | Salein | 68/58 |
| 6,463,767 | B2 * | 10/2002 | Uzkureit et al. | 68/58 |
| 6,612,138 | B2 * | 9/2003 | Ryu et al. | 68/58 |

FOREIGN PATENT DOCUMENTS

| | | | |
|---|---|---|---|
| DE | 4326496 | A1 * | 2/1995 |
| EP | 360059 | A1 * | 3/1990 |
| KR | 2004-69135 | | 8/2004 |

OTHER PUBLICATIONS

Electronic translation of DE 4326496.*
Electronic translation of DE 4326496, date not applicable.*

* cited by examiner

*Primary Examiner*—Joseph L Perrin
(74) *Attorney, Agent, or Firm*—Staas & Halsey LLP

(57) ABSTRACT

Disclosed herein is a drum type washing machine designed to continuously raise and drop wash water during washing operation to enhance washing efficiency. The drum type washing machine includes a tub to hold wash water, a rotational drum rotatably installed in the tub, and a water raising unit having a plurality of water pockets equipped in a rotating direction of the rotational drum to an inner rear side of the rotational drum to raise and drop the wash water when the rotational drum is rotated.

5 Claims, 4 Drawing Sheets

DRUM TYPE WASHING MACHINE

CROSS REFERENCE TO RELATED APPLICATION

This application claims the benefit under 35 U.S.C. §119 of Korean Patent Application No. 10-2005-0061269, filed on Jul. 7, 2005 in the Korean Intellectual Property Office, the disclosure of which is incorporated herein in its entirety by reference.

BACKGROUND OF THE INVENTION

1. Field of the Invention

The present invention relates to a drum type washing machine, and, more particularly, to a drum type washing machine designed to continuously raise and drop wash water during washing operation to enhance washing efficiency.

2. Description of the Related Art

For example, a drum type washing machine which can raise and drop wash water in order to enhance washing efficiency is disclosed in Korean Patent Laid-open Publication No. 10-2004-69135 (Laid-open Date: Aug. 4, 2004).

In the disclosure, the drum type washing machine includes a water tub installed in a housing to hold water, a rotational drum rotatably installed in the tub, and lifters equipped on an inner surface of the rotational drum to raise laundry when the rotational drum is rotated. Each of the lifters includes a lifting member having a discharge hole through which wash water introduced into the lifting member via through-holes of the rotational drum is discharged towards an inner portion of the rotational drum, and an opening/closing member equipped inside the lifting member to allow the wash water introduced into the lifting member to be accumulated therein and then poured into the rotational drum when the lifting member is moved to an upper side of the rotational drum.

In the drum type washing machine of the disclosure, the wash water is introduced into the lifting member when the lift member is moved to a lower side of the rotational drum during rotation of the rotational drum, and is supplied into the rotational drum when the lifting member is moved to the upper side of the rotational drum, thereby enhancing washing force.

However, since the drum type washing machine of the disclosure has three or four lifters uniformly separated a large distance from each other on the inner surface of the rotational drum, the wash water does not continuously fall. As a result, there is a limitation in enhancing the washing force.

SUMMARY OF THE INVENTION

Accordingly, it is an aspect of the present invention to provide a drum type washing machine designed to allow wash water to continuously rise and fall during washing operation, thereby enhancing washing efficiency.

Additional aspects and/or advantages of the invention will be set forth in part in the description which follows and, in part, will be apparent from the description, or may be learned by practice of the invention.

The foregoing and/or other aspects of the present invention are achieved by providing a drum type washing machine, including: a tub to hold wash water; a rotational drum rotatably installed in the tub; and a water raising unit having a plurality of water pockets equipped in a rotating direction of the rotational drum on an inner rear side of the rotational drum to raise and drop the wash water when the rotational drum is rotated.

Each water pocket may include a water inlet formed at the outer periphery of the water pocket, and a water outlet formed near the center of the rotational drum.

The water inlet may be formed in a rotating direction of the rotational drum to allow the wash water to easily flow into the water pocket.

Each water pocket may have a whirlwind shape curved in the rotating direction of the rotating drum, and having a width gradually increasing from the center of the rotational drum to the outer periphery of the rotational drum.

The water raising unit may include a ring-shaped rotational plate having an outer diameter smaller than an inner diameter of the rotational drum and coaxially fixed to the inner rear side of the rotational drum, and the water pockets may be protruded in front of the rotational drum from the rotational plate to define water holding spaces between the inner rear side of the rotational drum and the rotational plate, respectively.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
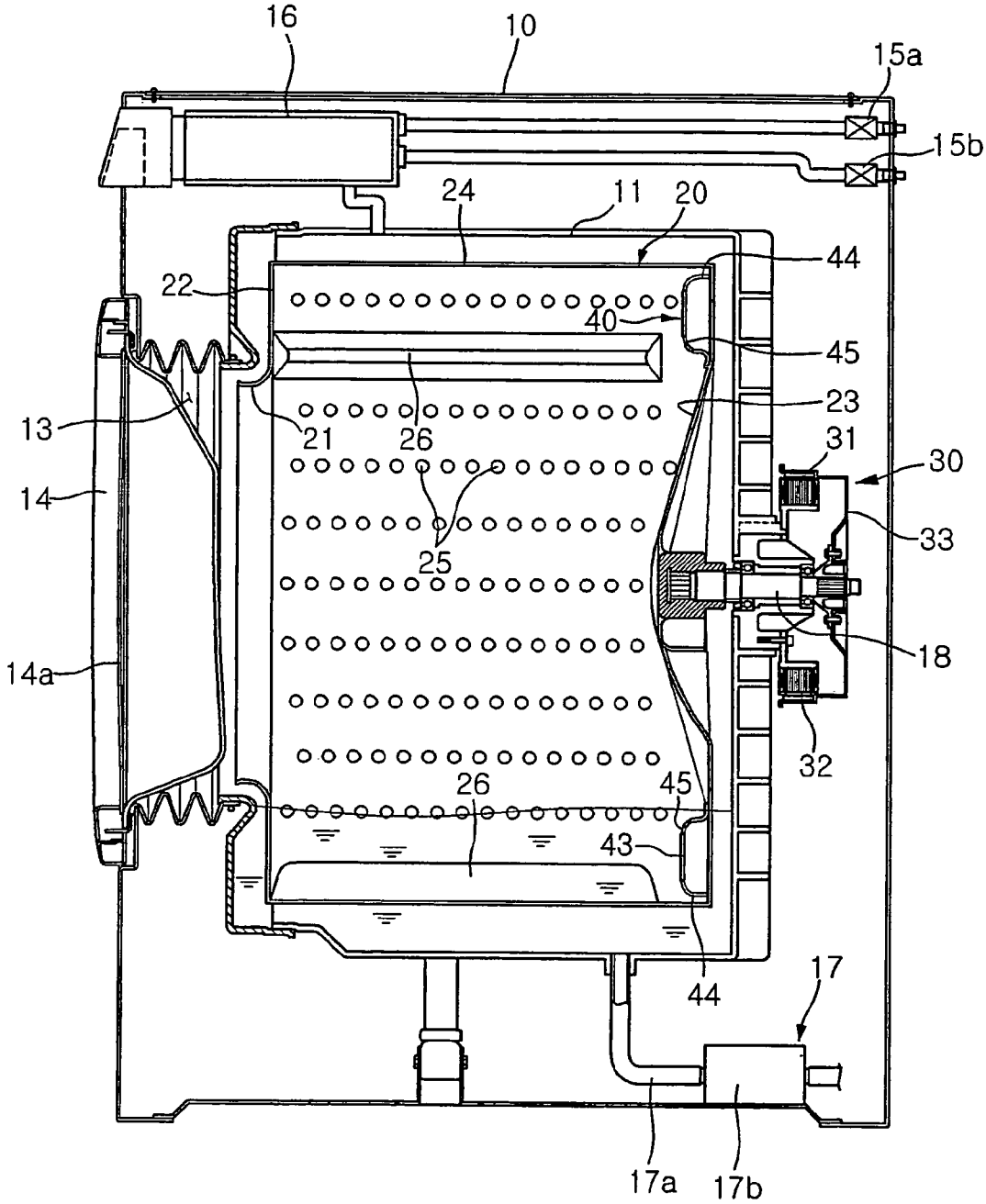
FIG. 1 is a cross-sectional view illustrating construction of a drum type washing machine according to the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

In FIG. 1, a drum type washing machine according to the invention includes a drum-shaped tub 11 equipped inside a body 10, and a rotational drum 20 rotatably equipped inside the tub 11.

On the front side of the body 10 is an opening 13 which has a door 14 hingedly equipped to the opening 13 to allow laundry to be input to or taken out from the rotational drum 20 through the opening 13. Water supply valves 15*a* and 15*b* to control water supply and a detergent supply unit 16 to supply detergent into the tub 11 are equipped above the tub 11, and a water discharge unit 17 including a water discharging pipe 17*a* and a water discharging pump 17*b* to discharge water from the tub 11 to the outside is equipped below the tub 11.

The rotational drum 20 includes the front side 22 having the opening 21 formed thereon, a rear side 23 having a rotational shaft 18 coupled to the center of the rear side 23, and a cylindrical section 24 connecting the front side 22 and the rear side 23 and having a plurality of through-holes 25 formed thereon. Additionally, the rotational drum 20 includes a plurality of lifters 26 equipped on an inner surface of the cylindrical section 24 to allow laundry to be raised and then fall inside the rotational drum 20 when the rotational drum 20 is rotated.

The rotational shaft 18 holds the rotational drum 20, and penetrates a rear side of the tub 11. A driving motor 30 is equipped at the rear side of the tub 11 to rotate the rotational shaft 18. The driving motor 30 includes a stator 31 fixed to the rear side of the tub 11, a rotor 32 rotatably equipped around the stator 21, and a holding plate 33 coupled at an outer periphery thereof to the rotor 32 and at the center thereof to the rotational shaft 18 to rotatably hold the rotor 32.

The drum type washing machine of the present invention further includes a water raising unit 40 equipped at an inner surface of the rear side of the rotational drum 20 to raise and drop wash water contained in a lower portion of the tub 11 when the rotational drum 20 is rotated.

Figure 2:
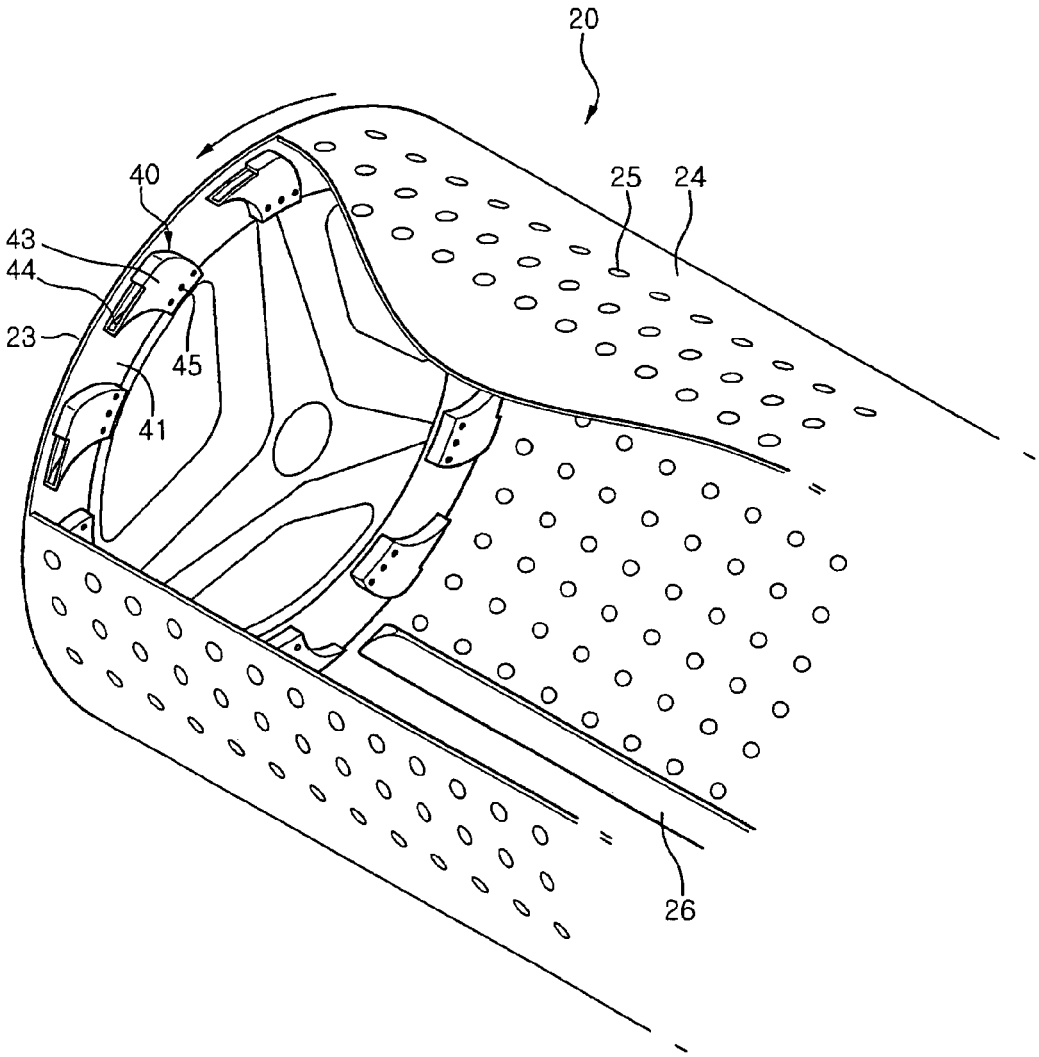
FIG. 2 is an exploded perspective view illustrating a drying apparatus of the drum type washing machine according to the present invention.
Figure 4:
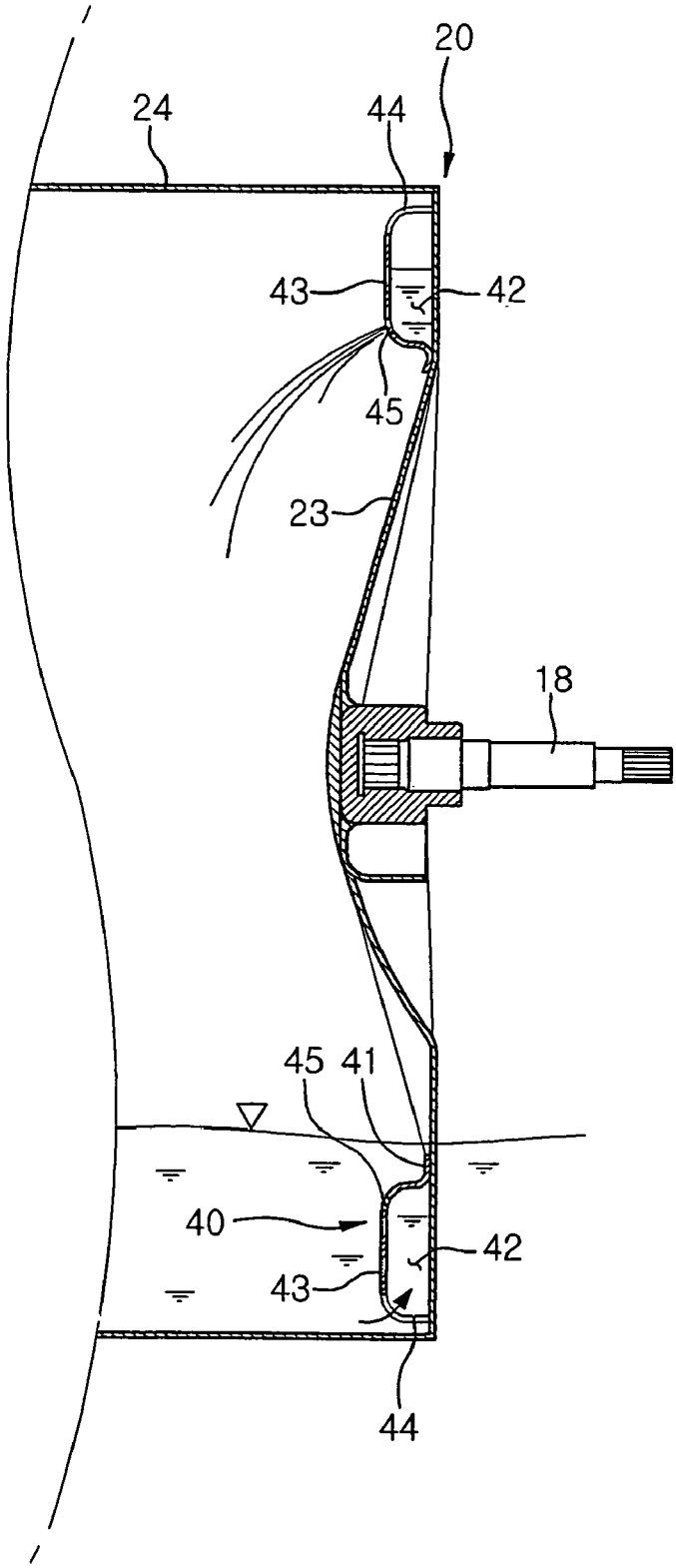
FIG. 4 is a cross-sectional view taken along line IV-IV'.

As shown in FIGS. 2 and 4, the water raising unit 40 includes a ring-shaped rotational plate 41 having an outer diameter smaller than an inner diameter of the rotational drum 20 and fixed to the inner surface of the rear side 23 of the rotational drum 20, and a plurality of water pockets 43 protruded in front of the rotational drum 20 from the rotational plate 41 in a rotating direction of the rotational drum 20 to define water holding spaces 42 (see FIG. 4).

The water pockets 43 are integrally formed to the rotational plate 41 by typical press forming when manufacturing the rotational plate 41 using a metallic plate. The water holding spaces 42 are formed between inner surfaces of the water pockets 43 and the rear side 23 of the rotational drum 20 by tightly fixing the rotational plate 41 to the inner surface of the rear side 23 of the rotational drum 20. At this time, the rotational plate 41 is fixed to the rear side 23 of the rotational drum 20 by welding or fastening of fixing screws (not shown).

Figure 3:
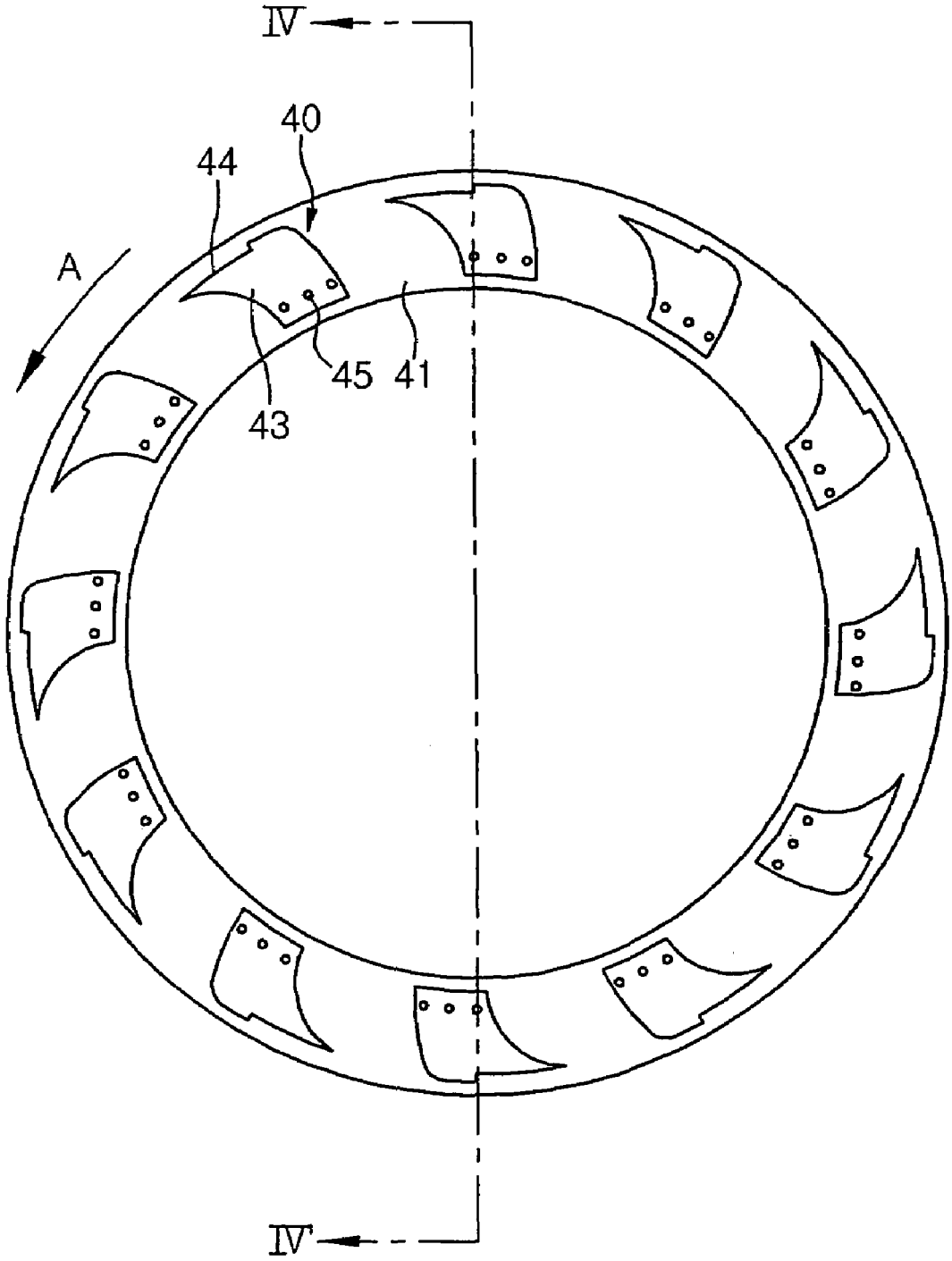
FIG. 3 is a front view illustrating the construction of a water raising unit of the drum type washing machine according to the present invention.

Each of the water pockets 43 includes a water inlet 44 formed at an outer periphery of the water pocket 43 near the outer periphery of the rotational drum 20, and a water outlet 45 formed near the center of the rotational drum 20. As shown in FIGS. 2 and 3, the water inlet 44 is formed in the rotating direction of the rotational drum 20 (indicated by arrow A). The structure of the water pockets 43 allows wash water to easily flow into the water pockets 43 through water inlets 44 thereof when the water pockets 43 are immersed in the wash water within the tub 11 during the rotation of the rotational drum 20, while allowing the wash water in the water pockets 43 to be easily discharged into the rotational drum 20 through the water outlets 45 when the water pockets 43 are moved to an upper side of the rotational drum 20.

Additionally, as shown in FIG. 3, each of the water pockets 43 has a whirlwind shape which is curved in the rotating direction of the rotating drum 20 (indicated by the arrow A), and has a width that gradually increases from the center of the rotational drum 20 to the outer periphery of the rotational drum.

Operation of the drum type washing machine is as follows.

After inputting laundry to the rotational drum 20 and supplying detergent to the detergent supply unit 16, the washing machine is operated, so that wash water and the detergent are supplied into the tub 11.

After the wash water is supplied into the tub 11, the rotational drum 20 is rotated by the driving motor 30 to wash the laundry. That is, the laundry is washed inside the rotational drum 20 in such a manner of being raised by the lifters 26 and then dropped.

During the washing operation as described above, the water raising unit 40 raises and drops the wash water to enhance washing efficiency. That is, the wash water flows into the water pockets 43 through water inlets 44 of the water pockets 43 when the water pockets 43 of the water raising unit 40 are moved to a lower side of the rotational drum 20 and are then immersed into the wash water by rotation of the rotational drum 20.

Meanwhile, when the water pockets 43 are moved to an upper side of the rotational drum 20 by rotation of the rotational drum 20, as shown in FIG. 4, the water inlets 44 are located higher than the water outlets 45, so that the wash water having flown into the water pockets 43 is discharged into the rotational drum 20 through the water outlets 45. Accordingly, the laundry is hit by falling wash water while being soaked thereby. This behavior is continuously performed through rotation of the rotational drum 20, so that washing efficiency is enhanced.

Additionally, as shown in FIG. 1, since the water raising unit 40 having the water pockets 43 is equipped to the inner surface of the rear side 23 of the rotational drum 20, when the wash water falls into the rotational drum 20 through the water outlets 45 of the water pockets, it can be observed through a window 14*a* of the door 14 during the washing operation. As such, the drum type washing machine of the invention enables a user to observe falling of the wash water, leading to visual satisfaction, as well as enhancing the washing efficiency.

One of the advantages of the present invention is that the drum type washing machine allows the wash water to be continuously raised and then dropped by the plurality of water pockets equipped to the rear side of the rotational drum during rotation of the rotational drum, enhancing washing efficiency in comparison to the conventional drum type washing machine.

Another advantage of the present invention is that the drum type washing machine has the plurality of water pockets equipped at the rear side of the rotational drum to allow falling of the wash water to be observed through the window of the door, providing visual satisfaction to the user.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A drum type washing machine comprising:

a tub to hold wash water and a rotational drum rotatably installed in the tub; and a plurality of water pockets formed only on an inner rear side of the rotational drum along an outer periphery of the rotational drum to raise and drop the wash water when the rotational drum is rotated, each of the plurality of water pockets being oriented to scoop the wash water from inside the rotational drum when the rotational drum is rotated in a rotating direction, wherein each water pocket comprises:

a water inlet formed at an outer periphery of the water pocket; and a water outlet formed near an inner periphery of the water pocket to outlet water towards a center of the rotational drum from the outer periphery of rotational drum.

2. The washing machine according to claim 1, wherein the water inlet is formed in the rotating direction of the rotational drum to allow the wash water to easily flow into the water pocket.

3. The washing machine according to claim 2, wherein the water pocket has a whirlwind shape curved in the rotating direction of the rotating drum and having a width gradually increased from the center of the rotational drum to the outer periphery of the rotational drum.

4. The washing machine according to claim 1, further comprising a ring-shaped rotational plate having an outer diameter smaller than an inner diameter of the rotational drum and coaxially fixed to the inner rear side of the rotational drum, wherein the water pockets protrude from the inner rear side of the rotational drum from the rotational plate toward a front of the rotational drum to define water holding spaces between the inner rear side of the rotational drum and the rotational plate, respectively.

5. A drum type washing machine comprising:

a tub to hold wash water and a rotational drum rotatably installed in the tub; and a plurality of water pockets formed only on an inner rear side of the rotational drum along an outer periphery of the rotational drum to raise and drop the wash water when the rotational drum is rotated, each of the plurality of water pockets being oriented to scoop the wash water from inside the rotational drum when the rotational drum is rotated in a rotating direction, wherein each water pocket comprises:

a water inlet formed at an outer periphery of the rotational drum; and a water outlet formed in the water pocket itself at an outer periphery of the rotational drum near to the water inlet.

* * * * *

UNITED STATES PATENT AND TRADEMARK OFFICE

CERTIFICATE OF CORRECTION

PATENT NO. : 7,610,781 B2
APPLICATION NO. : 11/302114
DATED : November 3, 2009
INVENTOR(S) : Choi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 518 days.

Signed and Sealed this

Twelfth Day of October, 2010

David J. Kappos

David J. Kappos
*Director of the United States Patent and Trademark Office*